US011293424B2

(12) United States Patent
Barth et al.

(10) Patent No.: US 11,293,424 B2
(45) Date of Patent: Apr. 5, 2022

(54) UNDER-OCCLUDING WIDE FLOW CHANNELS FOR PERISTALTIC PUMPS

(71) Applicants: Phillip W Barth, Portola Valley, CA (US); Leslie A Field, Portola Valley, CA (US)

(72) Inventors: Phillip W Barth, Portola Valley, CA (US); Leslie A Field, Portola Valley, CA (US)

(73) Assignee: SmallTech Consulting LLC, Menlo Park, CA (US)

( * ) Notice: Subject to any disclaimer, the term of this patent is extended or adjusted under 35 U.S.C. 154(b) by 247 days.

(21) Appl. No.: 16/556,187

(22) Filed: Aug. 29, 2019

(65) Prior Publication Data

US 2020/0072210 A1 Mar. 5, 2020

Related U.S. Application Data

(60) Provisional application No. 62/726,351, filed on Sep. 3, 2018.

(51) Int. Cl.
*F04B 43/00* (2006.01)
*F04B 43/12* (2006.01)

(52) U.S. Cl.
CPC ..... *F04B 43/0072* (2013.01); *F04B 43/12* (2013.01)

(58) Field of Classification Search
CPC ..... F04B 43/1238; F04B 43/1253; F04B 43/1261; F04B 43/1269; F04B 43/1284; F04B 43/0072; F04B 45/08; A61M 60/279; A61M 1/743; A61M 39/00; A61M 39/08; A61M 39/228; A61M 5/14232

See application file for complete search history.

(56) References Cited

U.S. PATENT DOCUMENTS 1,765,360 A * 6/1930 Baumann ..... F04B 43/0072 417/477.12
3,508,587 A * 4/1970 Mauch ..... F16L 11/121 138/119
4,275,761 A * 6/1981 Waldhauser ..... A01G 25/095 137/595
5,215,450 A * 6/1993 Tamari ..... A61M 1/3639 417/474

* cited by examiner

*Primary Examiner* — Kenneth J Hansen
(74) *Attorney, Agent, or Firm* — Shalini Venkatesh

(57) ABSTRACT

A flow channel suitable for use with a peristaltic pump comprises: an upper wall having a bowed upward shape; a lower wall having one of a bowed downward shape and a flat shape; and one or more spacers between the upper wall and the lower wall disposed between lateral edges of the upper and lower walls, each spacer having a height. The upper wall, lower wall, and the one or more spacers define a lumen. When the upper wall is compressed toward the lower wall by compressing members, the one or more spacers limit vertical movement of the compressing members such that the lumen is maintained in an under-occluded condition. In some cases, the bowing of one of the upper and lower walls has a recurved shape.

11 Claims, 12 Drawing Sheets

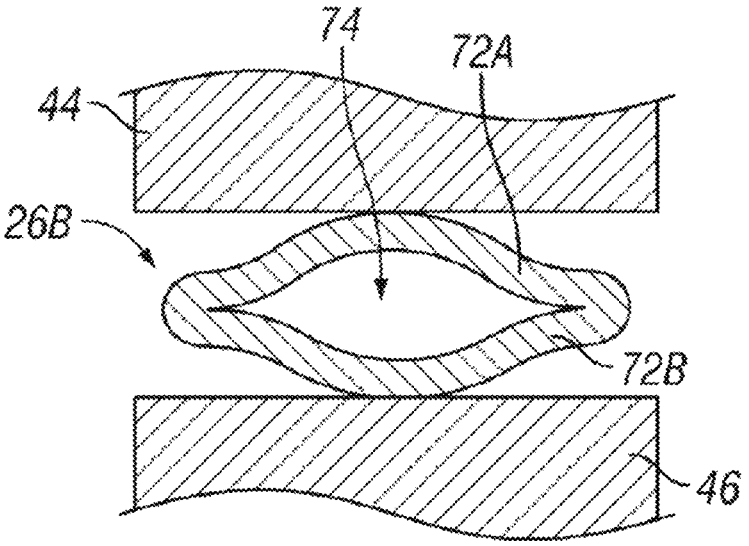
FIG. 5B
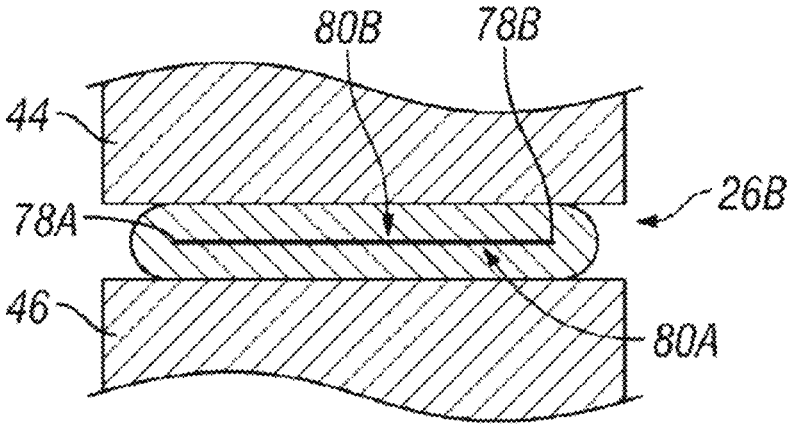
FIG. 5C
Prior art
FIG. 3

UNDER-OCCLUDING WIDE FLOW CHANNELS FOR PERISTALTIC PUMPS

CROSS REFERENCE TO RELATED APPLICATION

This application claims priority from U.S. Provisional Patent Application Ser. No. 62/726,351, entitled "Under-occluding wide flow channels for peristaltic pumps", filed on Sep. 3, 2018, which is hereby incorporated by reference as if set forth in full in this application for all purposes.

BACKGROUND

Hemodialysis and cardiopulmonary bypass are two medical procedures in which blood is extracted from the body, treated, and pumped back into the body. Hemodialysis is used to cleanse toxins from the blood of a patient in kidney failure, and uses a typical blood flow rate of 400 milliliters per minute (ml/min). Cardiopulmonary bypass is used to oxygenate the blood of a patient undergoing open heart surgery, and uses a typical blood flow rate of 4 liters per minute (1/min).

A peristaltic pump, often called a roller pump, is a fluid pump in which an enclosed flow channel is compressed by a roller or rollers, or by a series of compression blocks or fingers, to propel a fluid along the channel from a channel entrance to a channel exit, in rough analogy with the peristaltic pumping action of biological structures such as intestines. Advantageously, the fluid being pumped contacts only the interior surfaces of the flow channel, and complex components such as valves or pistons, which would be subject to leakage or sliding wear, are avoided.

Both hemodialysis (HD) and cardiopulmonary bypass (CPB) employ peristaltic pumps to pump blood. These pumps use compressible flow channels comprising soft, round tubing having a central lumen, typically made of polyvinyl chloride (PVC) softened by plasticizers such as phthalates. The tubing is compressed, and its lumen is partially or fully occluded by passing rollers, or blocks as mentioned above, to push blood through the flow channel.

Six problems arise from the use of this soft, round tubing. One problem is spalling of particles from the tubing into the blood flow as the lateral edges of the soft tubing undergo wear during compression due to stretch and shear of the tubing material [1]. A second problem is spalling of particles from the tubing into the blood flow as the interior faces of the soft tubing undergo contact caused by roller compression, which contact can be a grinding contact when soft tubing is used. A third problem is leaching of plasticizers into the blood flow from tubing walls and spalled particles. A fourth problem is hemolysis (blood cell destruction) due to crushing of blood cells between interior faces of tubing walls. A fifth problem is hemolysis due to grinding of blood cells between interior faces of tubing walls. A sixth problem is hemolysis due to excessive fluid shear stress (for example in excess of 150-560 Pascals [2],[3]) caused by high velocity gradients in the blood near roller compression regions.

The problems of spalling due to crushing contact, spalling due to grinding contact, leaching of plasticizers, hemolysis due to crushing contact, hemolysis due to grinding contact, and hemolysis due to excessive fluid shear stress can be reduced by the pump operator (called a "perfusionist" in CBP practice) adjusting the pump roller force during setup to provide a tubing lumen which is not fully occluded ("under-occluded") during operation. For example, a tube having a circular lumen 12.7 mm in diameter in its uncompressed condition may be set up to have a gap of 1 millimeter (mm) between interior wall faces during compression by a roller. But this force adjustment is different for each tube due to manufacturing tolerances, and for a given roller force setting the lumen gap decreases during pump operation as the tubing wears.

Flow channels for peristaltic pumps having a non-round cross-sectional shape, which herein will be called the Davis-Butterfield shape, or DB shape, after the inventors, can have performance advantages over a round tube or hose, including low spallation, low mechanical stress, long channel life, and high-pressure capability. Also, as they allow for the use of stiff materials rather than soft materials, the need for plasticizers is reduced or eliminated. However, even in channels having the DB shape, pump roller pressure can cause contact of the interior faces of the flow channel, and can result in one or more of spalling from the contacting faces, leaching of plasticizers, and, in hypothetical cases where such channels might be used for pumping blood, hemolysis due to crushing of blood cells between the contacting faces, and hemolysis due to fluid shear stress. The roller force can be adjusted to leave a small residual lumen (under-occlusion) in a DB-shaped channel, the force being for example 5% less than the force required to completely occlude the lumen. However, due to manufacturing tolerances of the channel shape, that force level can't be accurately predicted and must be experimentally determined during use for each channel. No prior art using the DB channel shape for pumping blood is known.

Thus, there is a need for peristaltic pumps having flow channels which reduce or prevent one of spalling due to contact, spalling due to grinding, leaching of plasticizers, hemolysis due to crushing, hemolysis due to grinding, and hemolysis due to fluid shear stress. Further, there is a need for peristaltic pumps having flow channels which do not require the operator to adjust the pump for under-occluding pump operation.

SUMMARY

The present invention includes a flow channel suitable for use with a peristaltic pump, the flow channel comprising: an upper wall having a bowed upward shape; a lower wall having one of a bowed downward shape and a flat shape; and one or more spacers between the upper wall and the lower wall disposed between lateral edges of the upper and lower walls, each spacer having a height. The upper wall, lower wall, and the one or more spacers define a lumen, wherein, when the upper wall is compressed toward the lower wall by compressing members, the one or more spacers limit vertical movement of the compressing members such that the lumen is maintained in an under-occluded condition.

In one aspect, the bowing of one of the upper and lower walls has a recurved shape. In another aspect, one of the upper and lower walls has a uniform thickness. In yet another aspect, the lumen in its under-occluded condition has a lumen width and a lumen height, the lumen width being wider than the width of an under-occluded lumen of an area-equivalent circular tube exhibiting the same under-occluded lumen height.

The present invention includes a method of fabricating a flow channel suitable for use with a peristaltic pump; the method comprising: forming an upper wall having a bowed upward shape; forming a lower wall having a bowed downward shape; and joining the upper wall and lower wall to create a lumen of the flow channel; wherein one of forming the upper wall and forming the lower wall comprises forming one or more spacers protruding therefrom, such that after joining the upper wall and lower wall, the one or more spacers serve as lateral bounds for the lumen; and wherein, when the upper wall is compressed toward the lower wall by compressing members, the one or more spacers limit vertical movement of the compressing members such that the lumen is maintained in an under-occluded condition.

BRIEF DESCRIPTION OF THE DRAWINGS

FIG. 3 (Prior Art) illustrates a non-round Davis-Butterfield cross-sectional flow channel shape.

FIG. 5 (Prior Art) illustrates another type of flow channel having a non-round cross-sectional shape.

DETAILED DESCRIPTION OF EMBODIMENTS

Embodiments described herein include a flow channel suitable for use with a peristaltic pump, the channel having spacer features at the lateral edges of the flow channel which provide under-occlusion to reduce or prevent one of spalling, leaching of plasticizers, and hemolysis. The flow channel may have upper and lower walls having a shape similar to that of walls in a Davis-Butterfield flow channel, or to that of walls in a flow channel having another advantageous shape. In another aspect, the invention comprises a flow channel having a compressed lumen width larger than the compressed lumen width of an area-equivalent circular tube, thereby providing reduced hemolysis due to fluid shear stress. In another aspect, the invention comprises a planar flow channel plate incorporating the above flow channel. In yet another aspect, a disposable kit for a peristaltic pump comprises the above flow channel and one or more additional elements; wherein the flow channel and the one or more additional elements are integrated to form a single assembly.

Figure 1:
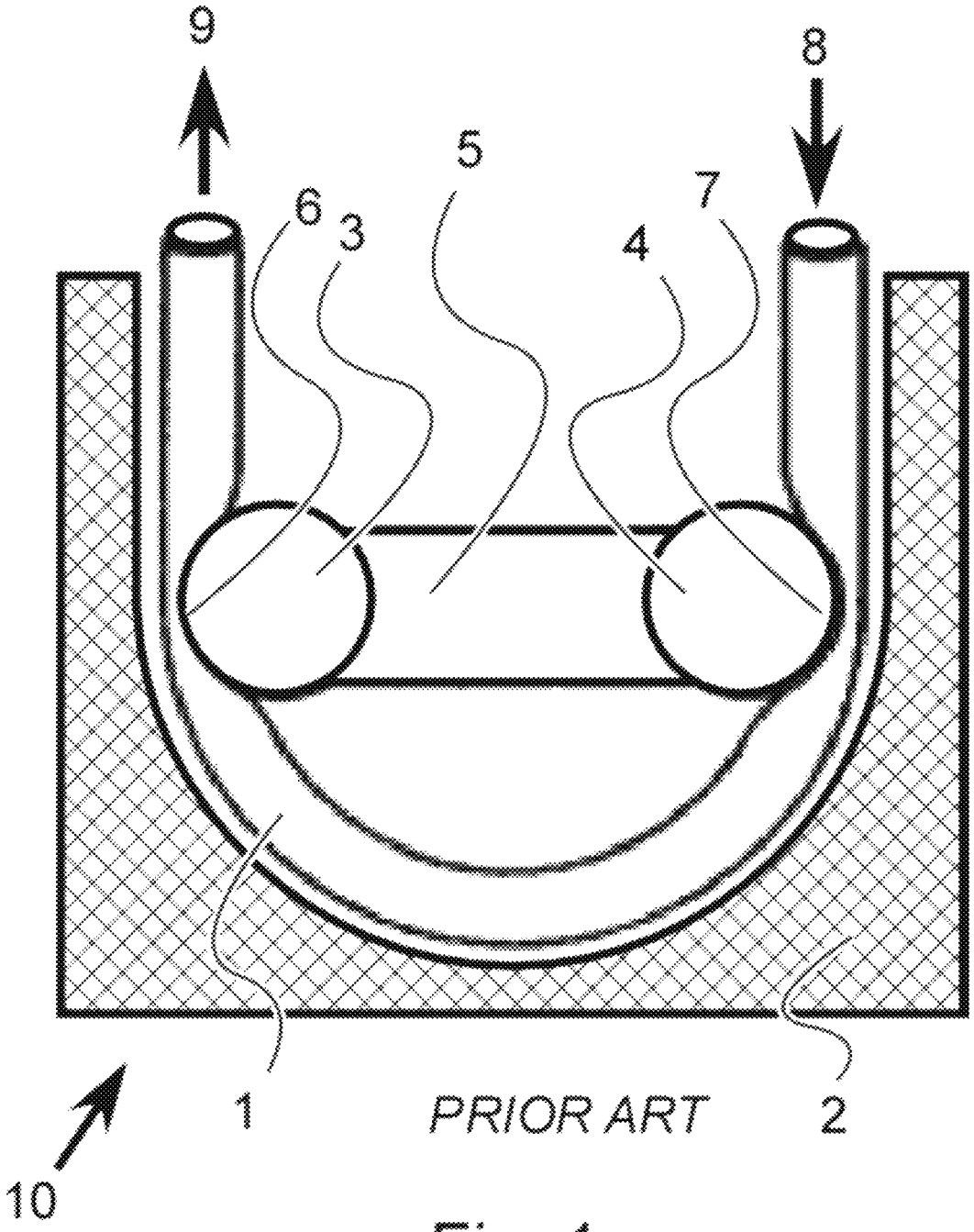
FIG. 1 (Prior Art) illustrates the basic principle of a circumferential-roller peristaltic pump.

FIG. 1 illustrates the basic principle of a prior-art circumferential-roller peristaltic pump 10. Flexible tube 1 sitting within rigid case member 2 contains the fluid to be pumped, and is compressed by cylindrical rollers 3 and 4 on rotating arm 5 at regions 6 and 7. If arm 5 rotates clockwise, the rollers 3 and 4 move the compression regions 6 and 7 clockwise, causing fluid to be sucked in at 8 and expelled at 9. Rigid case member 2 can be called a stator and rotating arms 5 can be called a rotor. The stator 2 and the rollers 3 and 4 comprise the compression members of the pump.

In FIGS. 2 through 10 of the present disclosure, the orientation of flow channels is shown such that a roller or other compression member can compress the flow channel vertically from above or below, and such that the lateral dimensions of the flow channel can increase under vertical compression while the vertical dimension of the flow channel can decrease.

Descriptive language in this disclosure and in associated claims refers to flow channels in the orientations shown in FIGS. 2 through 10, using terms such as upper, lower, top, bottom, lateral, left, right, vertical, horizontal, width, and height, but that language is a convenience for purposes of description and explanation of flow channels in those particular orientations, and is not limiting of the invention, nor is the orientation chosen a limitation of the invention.

Figure 2A:
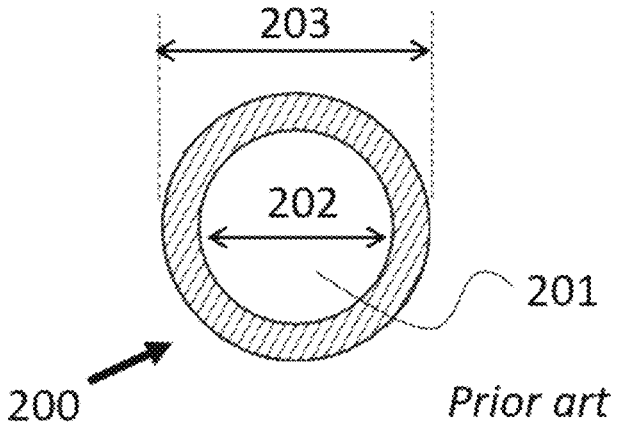
FIG. 2A (Prior Art) illustrates a cross section of a soft, round tube as may be used in peristaltic pumps, in a relaxed state.

FIG. 2A shows a cross section taken through a soft, round tube 200 as typically used for a traditional peristaltic roller pump, in its relaxed, uncompressed state. The tube in this instance has a circular lumen 201 in the center of the tube which is open or patent or non-occluded and has a diameter 202. In a typical example, to be discussed further below, diameter 202 is 12.7 mm.

Figure 2B:
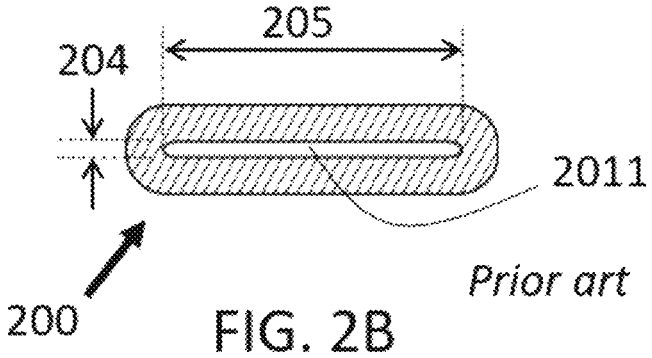
FIG. 2B (Prior Art) illustrates a cross section of a soft, round tube as may be used in peristaltic pumps, in a compressed state wherein the lumen is under-occluded FIG. 2C (Prior Art) illustrates a cross section of a soft, round tube as used in peristaltic pumps, in a compressed state wherein the lumen is fully occluded.

In FIG. 2B the tube 200 is compressed as it would be between a roller and a stator, and circular lumen 201 has been compressed and widened to form lumen 2011. Lumen 2011 is almost occluded and still under-occluded, leaving an under-occlusion gap of height 204 and width 205, which, in this exemplary case, may be roughly 1 mm and 19.5 mm respectively. The under-occluded setting serves to minimize hemolysis due to fluid shear stress during pumping of blood.

Figure 2C:
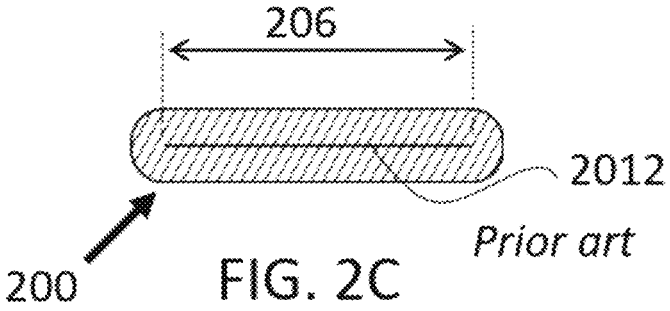

FIG. 2C illustrates complete occlusion of the tube 200. Lumen 201 has been fully compressed to form closed lumen 2012. The width 206 of the compressed lumen 2012 in this exemplary case is 19.95 mm. However, completely occluded flow channels produce high hemolysis and are not used in hemodialysis or cardiopulmonary bypass.

A major disadvantage of roller pumps using soft tubing is that the under-occlusion setting must be done manually, resulting in a large variability depending on the operator. Because of production tolerances in wall thickness, the occlusion setting of a roller pump needs to be controlled before each procedure in order to avoid excessive blood damage and to ensure correct blood flow.

Another disadvantage of soft round tubing is excessive shear (change in velocity versus position), which leads to excessive shear stress on blood cells, which leads to hemolysis. Computational fluid dynamic (CFD) simulations[1] show that shear stress occurring in soft, round tubing used in peristaltic pumps can produce hemolysis even when the tubing is under-occluded, having for example an under-occlusion gap 204 of 1 mm between interior walls of the tube. The hemolysis problem arises at regions near the roller-compressed portions of the tubing as the fluid in the tube squirts rapidly ahead of the compression roller, producing damaging peak shear stress of 994 Pa or higher in relation to a cell damage threshold which has been variously estimated to be 150-560 Pa.

[1]J. W. Mulholland, J. C. Shelton, and X. Y. Luo, "Blood flow and damage by the roller pumps during cardiopulmonary bypass," J. Fluids Struct., vol. 20, no. 1, pp. 129-140, January 2005.

For a circular tube having a lumen diameter D, which is equal to the lumen's width in its uncompressed state, the length of the lumen's inner perimeter is $\pi D$, which is approximately equal to 3.14 D, and the lateral width of the lumen in its compressed state is approximately half that inner perimeter i.e. $\pi D/2$ or approximately 1.57 D.

It does not seem to have been appreciated until the present invention that the magnitude of shear stress is related to the distribution of flow over the compressed lumen width ($\pi D/2$ in a circular channel) and that if the compressed width can be increased sufficiently in an "area-equivalent" wider flow channel, then the flow can be distributed over this larger width, and the magnitude of shear stress in an under-occluded lumen can be decreased to a non-damaging, non-hemolytic level.

The term "area-equivalent" is used herein to refer to two different flow channels having in their uncompressed states equal cross-sectional lumen areas. Other factors being equal, two channels which are area-equivalent require equal pump roller speeds to produce equal flows. The present invention as described herein can increase the width of the compressed under-occluded lumen by a factor of more than two, and as much as three, compared to the width of the compressed under-occluded lumen of an area-equivalent circular tube.

The word "round" used herein to describe flow channel shapes connotes flow channels having lumens which, when viewed from inside the lumen, have a shape which is concave everywhere, such as a circle, oval, or ellipse. Flow channel shapes having points, cusps, tips, or regions which are convex when seen from within the lumen are non-round.

Figure 11:
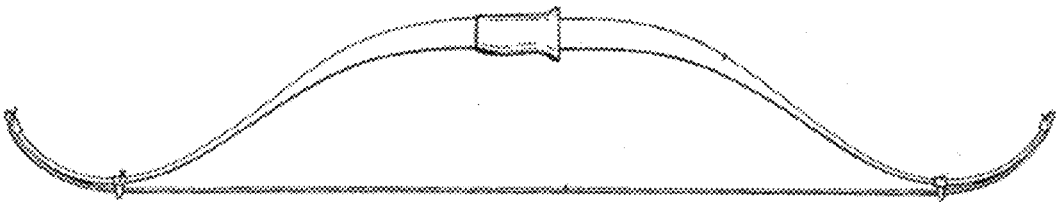
FIG. 11 Prior Art
FIG. 11 (Prior Art) illustrates a recurve archery bow.

FIG. 3, a reproduced version of FIG. 5 of U.S. Pat. No. 9,683,562, illustrates a prior-art Davis-Butterfield flow channel having a non-round cross-sectional shape. The channel is shown in its relaxed, uncompressed state (above) and in its compressed, occluded shape (below). Each channel wall in its relaxed condition is bowed upward or downward in a recurved shape, somewhat like the shape of a recurve archery bow, for example as in the recurve bow 4 shown in FIG. 11 reproduced from FIG. 1 of U.S. Pat. No. 3,070,083. The upper and lower walls of the Davis-Butterfield channel shown in FIG. 3 make contact with one another at features which can be called cusps or tips or points at either lateral edge of the channel. As viewed from within the lumen, the channel walls have some regions which are concave and some regions which are convex. Such channels can be formed by extrusion or by lamination of two separate sheets.

Figure 12:
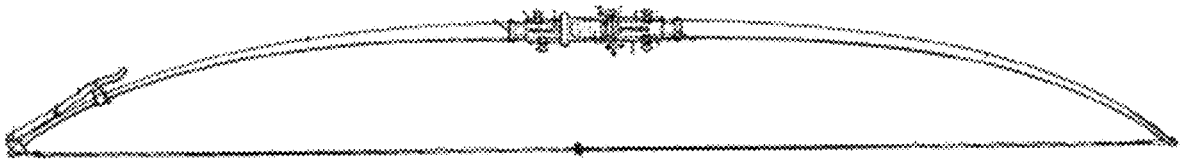
FIG. 12 Prior Art
FIG. 12 (Prior Art) illustrates an archery bow having a simply curved shape

FIG. 5, showing reproduced versions of FIGS. 1 and 2 of U.S. Pat. No. 5,088,522, illustrates a prior-art flow channel having a non-round cross-sectional shape. The channel is shown in its relaxed, uncompressed state (left) and in its compressed, occluded shape (right). Each channel wall in its relaxed condition is bowed upward or downward in a simply curved manner somewhat like the shape of a traditional wooden longbow, for example as in the collapsible longbow shown in FIG. 12, reproduced from FIG. 1 of U.S. Pat. No. 2,001,470. The upper and lower walls of the prior-art flow channel shown in FIG. 4 make contact with one another at features which can be called cusps or tips or points at either lateral edge of the channel. As viewed from within the lumen, the channel walls are always convex except where they contact one another at the lateral edges of the lumen, thereby forming cusps. Such channels can be formed, in peristaltic pump tubing applications, by extrusion or lamination.

Figure 4:
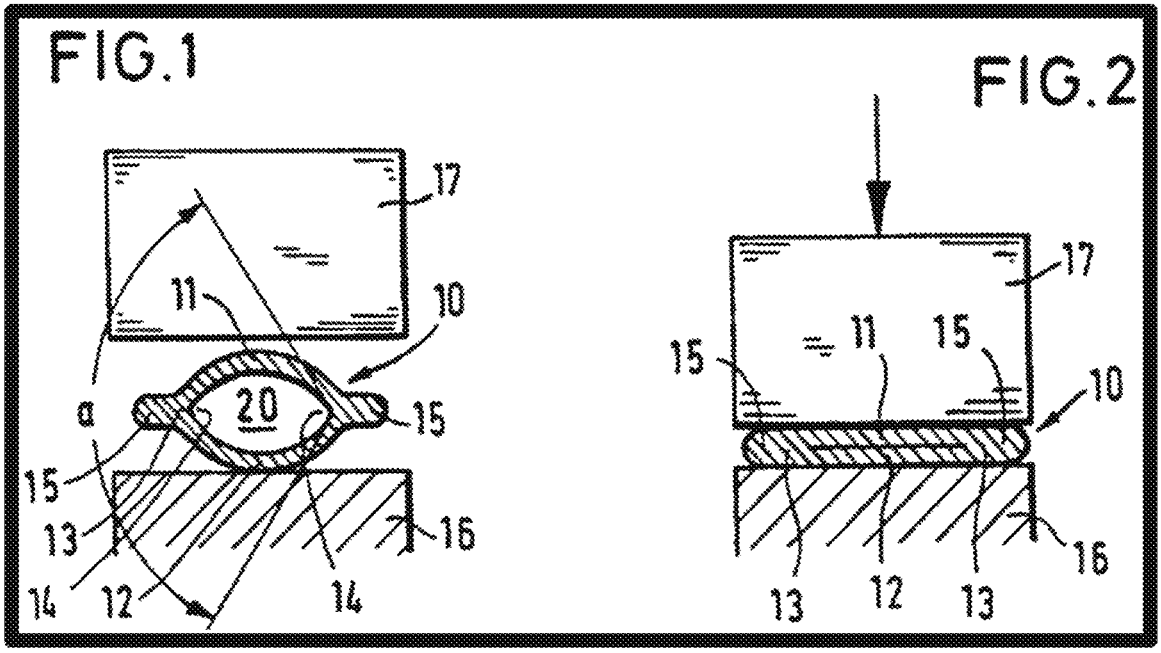
Prior art FIG. 4

If non-round flow channels having channel walls similar to those in FIG. 3 or 4 can be modified to be one of under-occluding, or of having a width, when compressed but under-occluded, greater than that of an under-occluded area-equivalent circular tube, then problems of spalling or hemolysis, or both, can be greatly reduced or prevented.

Figure 5A:
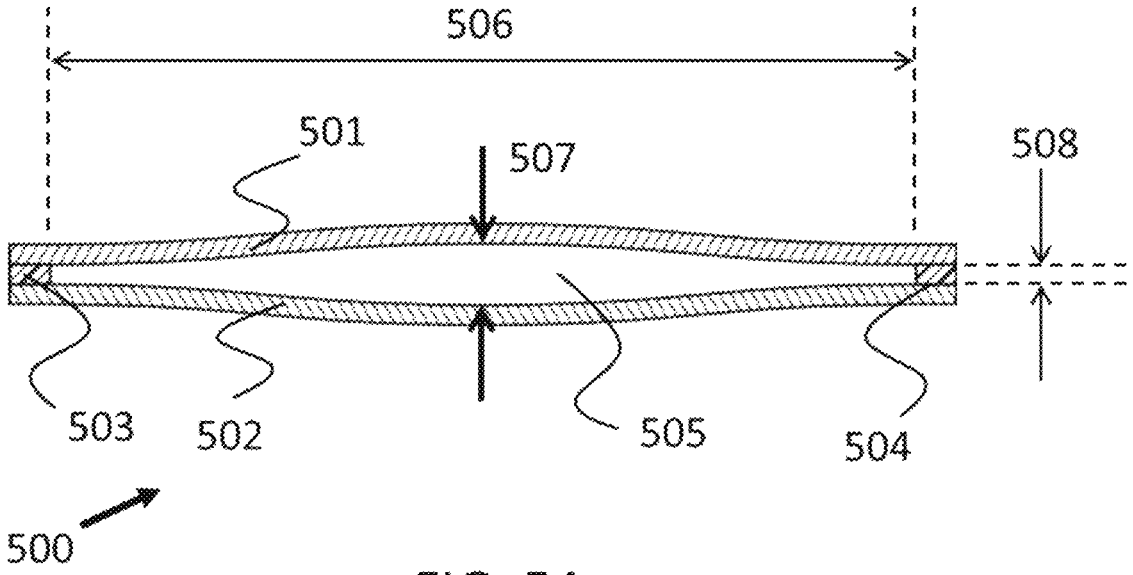
FIG. 5A illustrates a cross section of a flow channel in a relaxed state according to one embodiment of the present invention.

FIG. 5A illustrates a cross section of a non-round flow channel 500 according to one embodiment of the present invention, the flow channel dimensions being chosen to provide a channel area-equivalent to that of the circular tube 200 in FIG. 2. The channel 500 cross section comprises a stiff upper wall 501 having a recurved bowed shape and a uniform thickness, a stiff lower wall 502 having a recurved bowed shape and a uniform thickness, and stiff spacers 503 and 504 disposed between the left and right edges of walls 501 and 502. Advantageously, the features 501, 502, 503, and 504 can comprise one or more of rigid polyvinyl chloride (PVC) without plasticizers, or chlorinated polyvinyl chloride (CPVC), or polyether ether ketone (PEEK), or other stiff material. In this example, rigid PVC is used. The width 506 of the channel lumen in its uncompressed state is 60 mm. The lumen has a central gap height 507 of about 3.5 mm. The spacers 503 and 504 have a vertical thickness 508 of roughly 1 mm.

The use of a recurved shape for the flow channel walls has a key advantage over its use in the prior-art Davis-Butterfield channels. A recurved channel wall shape of the present invention is defined, for example with reference to upper wall 501, as a shape that, proceeding from a starting point, for example at the left, towards the end point, in this example at the right, starts off with a zero slope at the leftward extent of the lumen, then in a first section curves smoothly upward until it reaches an inflection point at a point of maximum positive slope, then in a second section curves smoothly downward until it reaches zero slope at a lateral midpoint between the two lumen lateral edges, then in a third section curves smoothly downward until it reaches another inflection point at a point of maximum negative slope, then in a fourth section curves smoothly upward again until it reaches zero slope at the rightward extent of the lumen. The recurved shape serves to distribute mechanical bending stress, experienced during channel compression or distension, over the width of the channel instead of merely concentrating stress at channel edges. Ideally for the purposes of stress distribution, each of the four sections is of equal width, but less-than-ideal section widths will function within the spirit and scope of the present invention.

The shape description above is expressed in terms of shape change from left to right. Of course, the shape could equally well have been defined with a starting point at the rightward extent of the lumen and an end point at the leftward extent.

In the Davis-Butterfield flow channel shape the upper channel wall meets the lower channel wall at two cusps or notches or points having acute angles which are estimated, from examining the figures in U.S. Pat. No. 9,683,562, to be less than 5 degrees.

It is well known that acute angles such as those shown in FIG. 3 can produce high stress leading to crack propagation, for example when the flow channel is distended by being subjected to internal fluid pressure. The absence of such acute angles in the present invention provides a performance advantage of the present invention. Unlike the prior-art Davis-Butterfield channel, there are no corners or cusps in the flow channel 500 (or 600 in FIG. 6, to be discussed below) having an angle more acute than 90 degrees. Thus, flow channels of the present invention are better able to endure high internal pressure and resist bursting under high internal pressure than are Davis-Butterfield flow channels of similar dimensions, comprising the same material. The ability to resist bursting under internal pressure is an important characteristic of blood pumps used for hemodialysis and cardiopulmonary bypass, because bursting can result in a large loss of the patient's blood.

In contrast to the burst pressure advantage gained using a recurved wall shape, adapting a simply-curved wall shape as shown in FIG. 4 to the present invention gives fewer advantages. A simply-curved shape as in FIG. 4 tends to concentrate bending stresses at two cusps or notches or points at the left and right edges of the flow channel, rather than spreading the bending stresses out across the width of the channel, thus producing high stress magnitude at the lateral channel edges. Using the spacers of the present invention between simply-curved walls lessen stress, just as when using a recurved wall shape, but the stress levels remain higher in the simply-curved case than when using recurved walls.

Intermediate wall shapes between simply-curved and recurved are possible. For example, an upper wall can begin as would a recurved wall shape on the left, starting off with a zero slope at the leftward extent of the lumen, then in a first section curving smoothly upward until it reaches an inflection point at a point of maximum positive slope, then in a second section curving smoothly downward until it reaches zero slope at a lateral midpoint between the two lumen lateral edges, but then departing from the full recurved shape by curving smoothly downward until it reaches the right lateral edge of the lumen. A lower wall shape can, for example, be an upside down left-right mirror image of the upper wall shape described above.

Figure 5B:
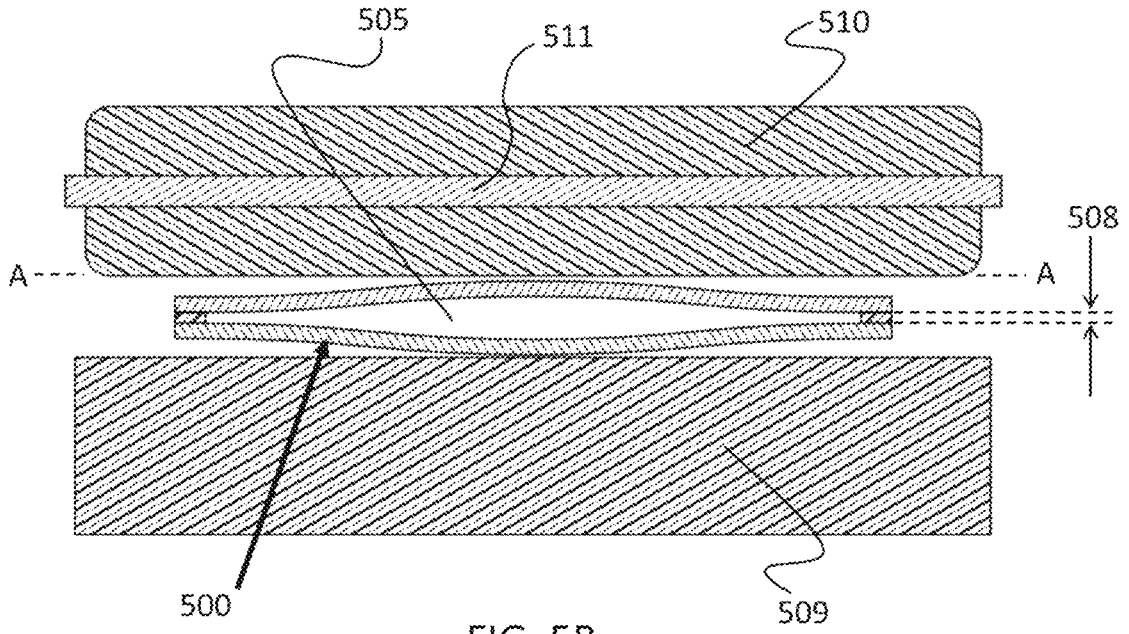
FIG. 5B illustrates a cross section of a flow channel according to one embodiment of the present invention, positioned between a platen and a roller.

FIG. 5B illustrates the flow channel 500 positioned between a flat rigid stator 509 beneath the flow channel and a cylindrical roller 510 above the flow channel, the roller rolling about an axle 511 and exhibiting a lower bearing surface which is indicated by two dashed lines (both marked A) in the plane of the drawing.

Figure 5C:
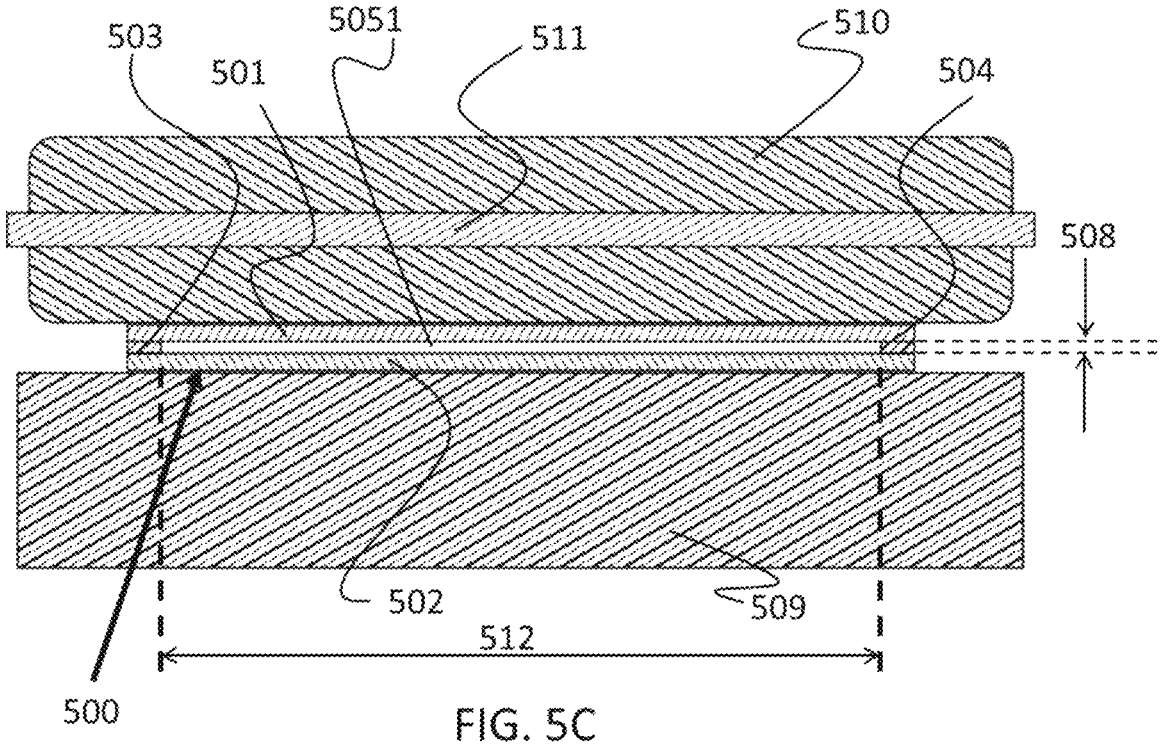
FIG. 5C illustrates a cross section of a flow channel in a compressed and under-occluded state according to one embodiment of the present invention.

FIG. 5C illustrates the flow channel 500 in a compressed state. The channel has been compressed between stator 509 and roller 510 until it has reached a hard stop against spacers 503 and 504, leaving an under-occluded lumen 5051 with a height 508 of roughly 1 mm, the height being determined by the thickness of the spacers 503 and 504. The width 512 of the lumen in its compressed state is roughly 60.1 mm. The walls 501 and 502 are flattened across the width 512.

The use of uniform wall thicknesses for walls 501 and 502 is advantageous but is not essential to the invention. Walls having non-uniform thickness can be present, due for example to manufacturing tolerances, or due to a desire to create a flow pattern shifted more toward the channel edges or the channel center.

The width 512 of under-occluded lumen 5051, with a value of 60.1 mm, is more than three times the width 205 of under-occluded lumen 2011 in FIG. 2B, with a value of 19.5 mm. Therefore, flow in under-occluded lumen 5051 is distributed over a width more than three times (60.1 mm divided by 19.5 mm equals 3.08) as large as that in under-occluded lumen 2011, and the fluid shear stress in lumen 5051 is correspondingly less than one-third that in lumen 2011 for equal flows in both lumens.

For a given under-occluded lumen height in both a non-round channel of the present invention and an area-equivalent circular channel, a "lumen width ratio" or LWR can be defined as the width of the under-occluded lumen in the non-round channel to the under-occluded lumen in the area-equivalent circular channel. For the example above, the LWR is equal to 3.08.

In contrast to soft, round tubing, the flow channels of the present invention benefit from the use of stiff materials having high elastic modulus and high hardness rather than soft materials having low elastic modulus and low hardness. For example, soft round tubing used for peristaltic pumps is recommended to have a Shore A Durometer hardness less than 65[2], which corresponds to an elastic modulus (Young's modulus) less than 24 megaPascals (MPa). In contrast, rigid polyvinyl chloride (PVC) advantageously employed in the present invention has a Shore D Durometer hardness of 80 and a Young's modulus of 3800 MPa, thereby being 158 times as stiff as soft, round tubing.

[2]"Material Selection for Peristaltic Pump Tubing|Whitepaper|Grayline LLC." [Online]. Available: https://www.graylineinc.com/whitepapers/peristaltic-pump-tubing.html. [Accessed: 27 May 2018].

A benefit of using material having a high Young's modulus is the ability to achieve a high lumen width ratio (LWR) for low shear stress and low hemolysis. For the example of channel 500 discussed herein, using rigid PVC, the LWR is 3.08. It can be shown by engineering modeling that as the Young's modulus decreases while area-equivalence with the circular lumen of FIG. 2A is held constant, the LWR also decreases. For instances similar to channel 500 and having area-equivalence to the lumen of FIG. 2A, at a Young's modulus of 300 MPa the LWR is roughly 1.5. At a value of Young's modulus of 24 MPa, which is equal to the Young's modulus of some soft, round tubing, the LWR is roughly 1.2, showing that even when soft materials are used the under-occluded channel shape of the present invention provides a moderate advantage in reducing hemolysis due to fluid shear.

Under-occluded lumens are necessarily leaky lumens, potentially allowing backflow through fluid resistance, so the pump roller speed must be adjusted to create the desired forward flow despite backward leakage. For the present invention the under-occluded gap height may be set so that fluid resistance of the under-occluded lumen matches that of an under-occluded lumen of area-equivalent round tubing. It is known that for a lumen having a width much greater than its height, fluid resistance varies as the inverse of the third power of lumen height. Thus, if the under-occluded lumen 2011 from FIG. 2B has a height of 1 mm, and the under-occluded lumen 5051 in FIG. 5C is three times as wide as width 205, then to exhibit the same fluid resistance the lumen 5051 should have a height 508 of roughly 0.7 mm. The slight reduction in under-occluded lumen height 508 below 1 mm causes a slight increase in fluid shear, but this is more than compensated for by the shear-reduction advantage of the increased width 512 of lumen 5051 relative to the width 205 of lumen 2011.

Figure 6A:
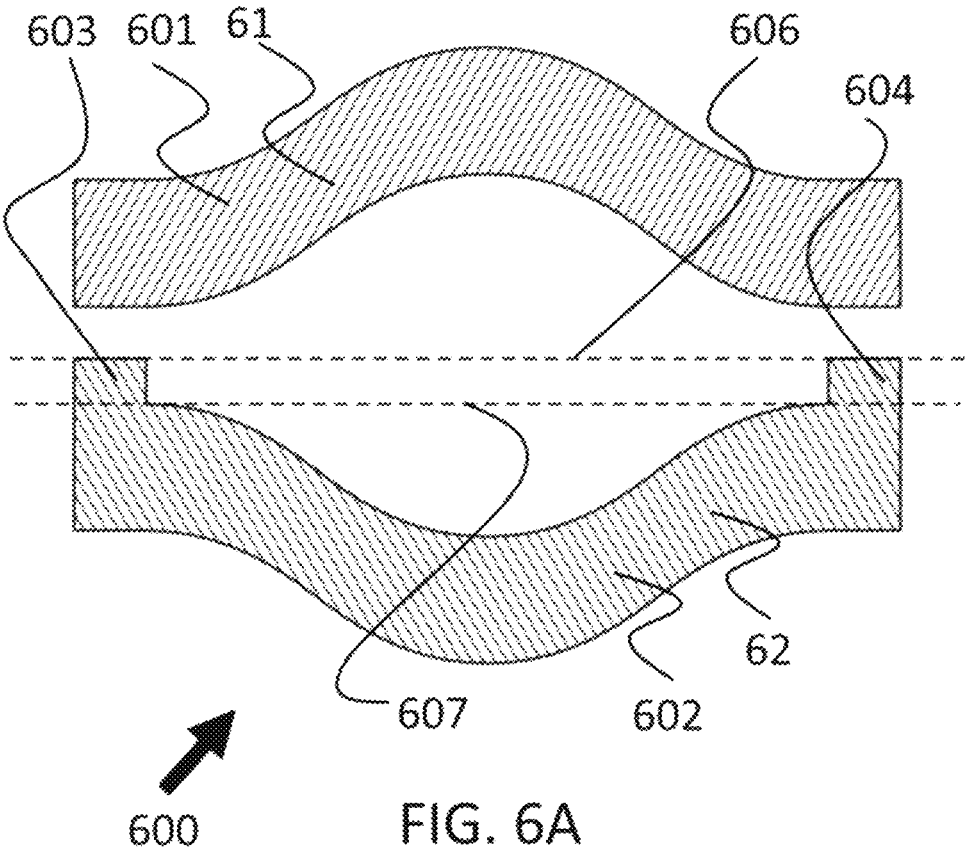
FIG. 6A illustrates cross sections of two components of a flow channel according to one embodiment of the present invention.
Figure 6B:
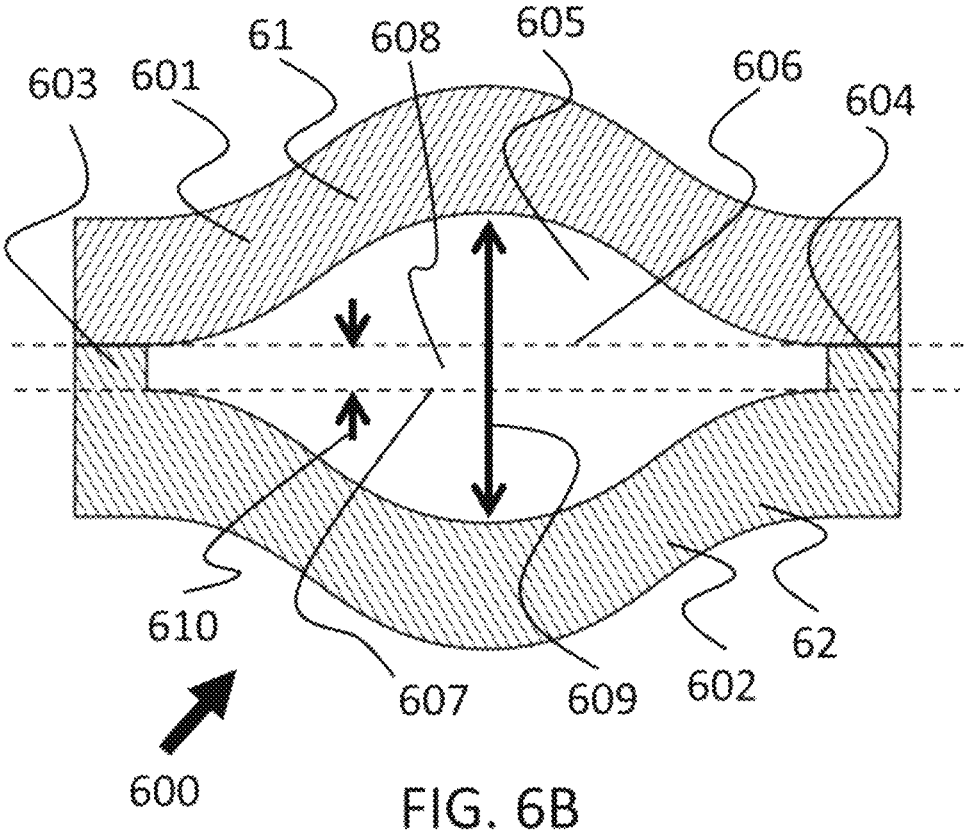
FIG. 6B illustrates a cross section of a flow channel in a relaxed state according to one embodiment of the present invention.
Figure 6C:
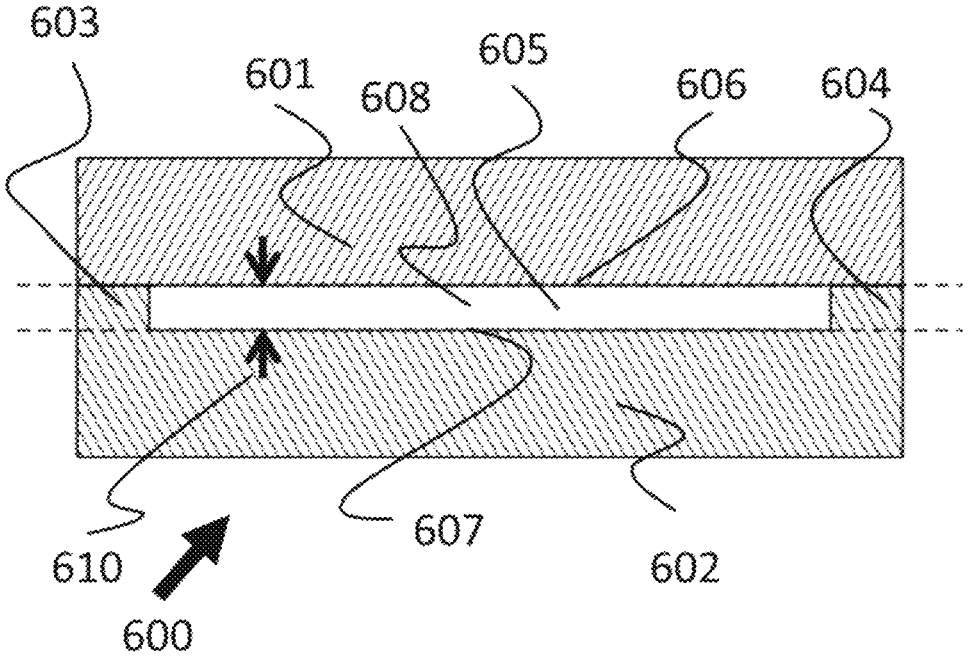
FIG. 6C illustrates a cross section of a flow channel in a compressed and under-occluded state according to one embodiment of the present invention.

FIGS. 6A, 6B, and 6C illustrate another embodiment 600 of the present invention. In these figures the vertical dimensions are exaggerated for clarity of illustration.

FIG. 6A shows two pre-formed channel halves 61 and 62 before they are laminated together to form the desired channel. Upper half 61 comprises upper wall 601 which is pre-formed into a recurved bowed shape. Lower half 62 comprises lower wall 602 which is pre-formed into a recurved bowed shape. In addition, lower half 62 comprises protruding features or spacers 603 and 604 which will later determine the under-occluded lumen height. Dotted lines 606 and 607 indicate the upper and lower extents of spacers 603 and 604.

FIG. 6B shows the flow channel 600 in a relaxed state after upper half 61 has been laminated to lower half 62. Lumen 605 has a central gap height 609, and the under-occluded lumen 608 (which appears during channel compression as in FIG. 6C) has a pre-set height 610.

FIG. 6C shows the flow channel 600 in a compressed state. Lumen 605 has been reduced in height by compression of walls 601 and 602 to form under-occluded lumen 608 having a height 610.

It will be appreciated that a flow channel of the present invention can be formed by extrusion of a channel having upper and lower walls and spacer features defined by the extrusion process, by lamination, by some combination of extrusion and lamination, or by other means.

Figure 7:
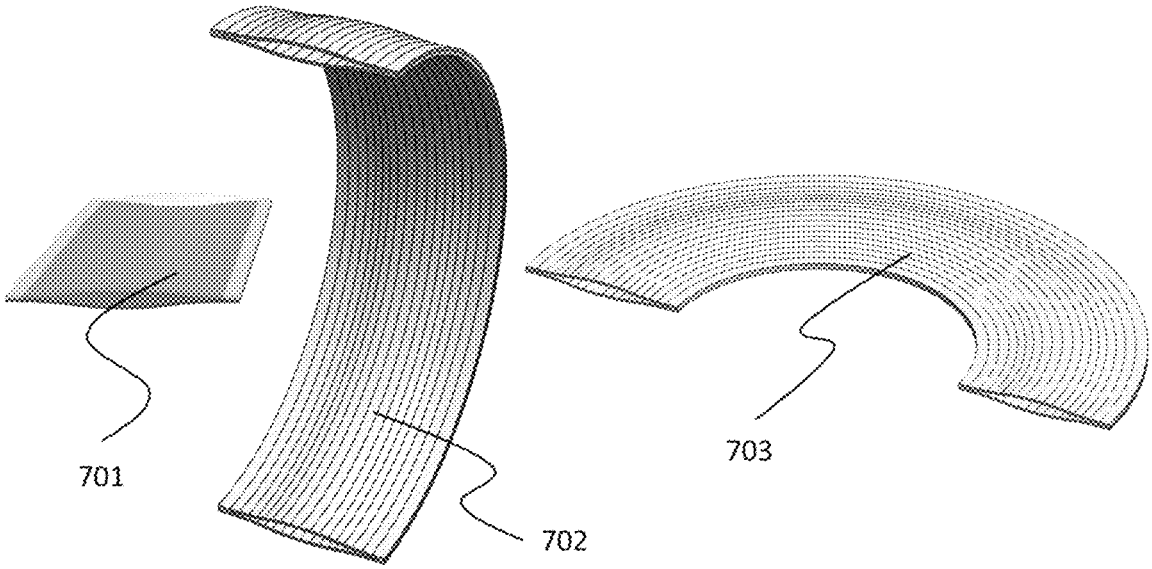
FIG. 7 illustrates three embodiments of flow channels of the invention.

Principles of the present invention can be embodied in channels having straight flow paths or curving flow paths. FIG. 7 shows three embodiments 701, 702, and 703 of flow channels. Embodiment 701 is a straight path channel, shown in perspective with the top wall of the channel rendered as transparent. In embodiment 702 the channel curves through 180 degrees about an axis parallel to any axis along which the width of the flow channel may be considered to be directed.

Channels like channel 702, with further extensions, are suitable for use in a circumferential-roller pump like that shown in FIG. 1. In embodiment 703, the channel curves through 180 degrees about an axis perpendicular to the plane in which the channel substantially lies. Channels like channel 703, with extensions, are suitable for use in face-roller pumps where rollers follow a generally planar path bearing against a face of the channel.

FIGS. 8A-8D illustrate a planar flow channel plate 800 embodying the present invention. Plate 800 can be formed by laminating together two separate sheets 810 and 811 of material that include strain relief means 807. Flow channel plate 800 includes a flow channel 801 which curves about an axis perpendicular to the plane in which the channel substantially lies, and has a semicircular portion 802 plus two straight portions 803 and 804. The flow channel has openings 805 and 806. Strain relief means 807 permit portions 802, 803, and 804 to expand laterally in the plane of the device when force is applied from above and/or below the plane of plate 800, for example by a roller, to occlude or partially occlude the flow channel 801 during pump operation. The magnitude of lateral expansion of channel 801 can be on the order of 0.1 mm as noted in the discussion above, regarding embodiment 500. Dashed rectangle 808 indicates the region of plate 800 illustrated in greater detail in FIGS. 8B-8D. Center hole 809 permits a pump drive shaft to pass through the plate 800. The openings 805 and 806 connect to further channel regions, not shown, which may provide a transition from the non-round, relatively wide cross section shape of channel 801 to conventional round flow channels, which can then connect in turn to conventional round tubing or fittings. Other features, not shown, may be present in flow channel plate 800, for example, through holes or alignment notches, useful for aligning and attaching the flow plate 800 in a peristaltic pump head, or laser markings identifying the channel size and shape and device serial number.

Figure 8A:
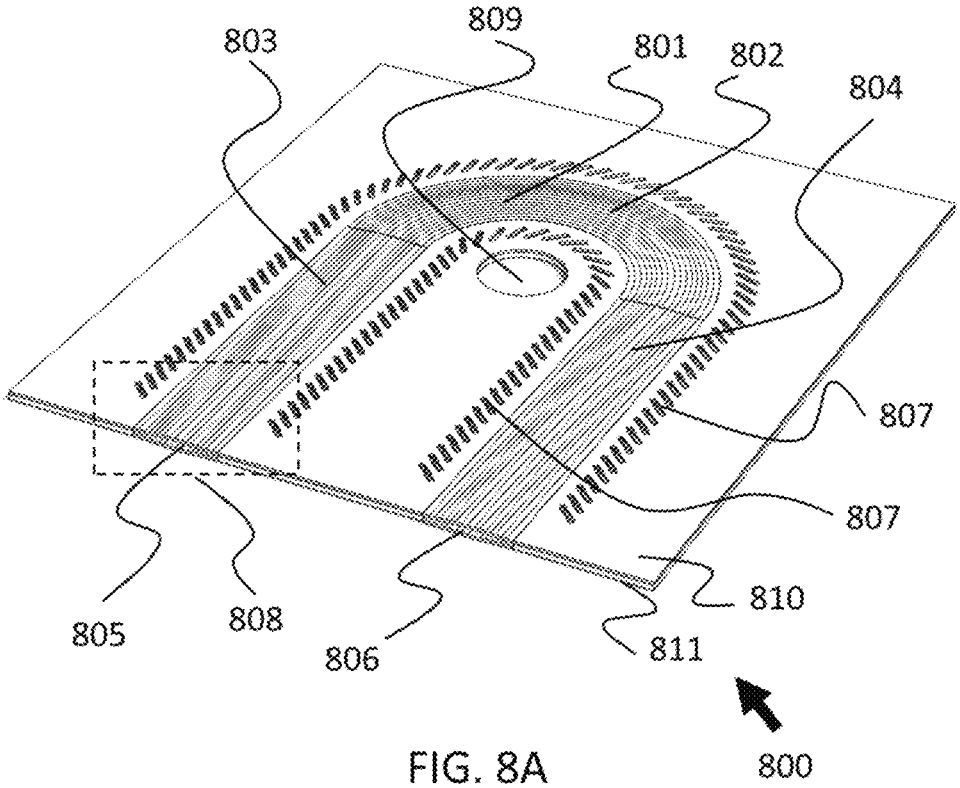
FIG. 8A illustrates a planar flow channel plate according to one embodiment of the present invention.
Figure 8B:
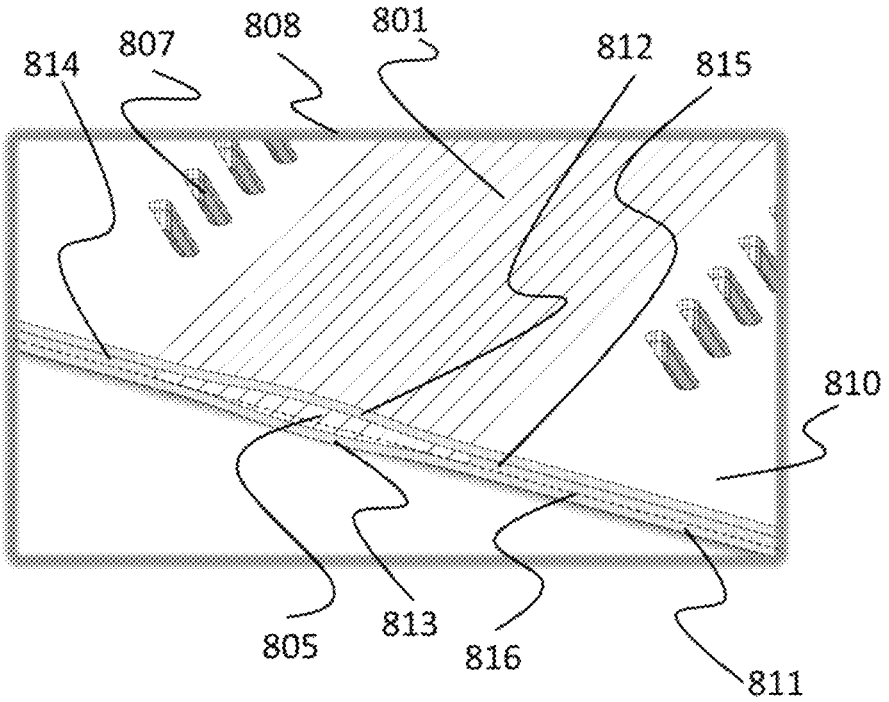
FIG. 8B illustrates a detail of a planar flow channel plate according to one embodiment of the present invention.

FIG. 8B shows some detail of area 808 around channel opening 805. Channel 801 is bounded by upper wall 812, lower wall 813, and spacers 814 and 815. Spacers 814 and 815 are formed as parts of lower plate 811, and dotted line 816 indicates their lower extent. The parallel lines running along channel 801 (diagonally in this figure) are present for purposes of drawing and illustration, but are not physical features of the flow channel plate 800.

Figure 8C:
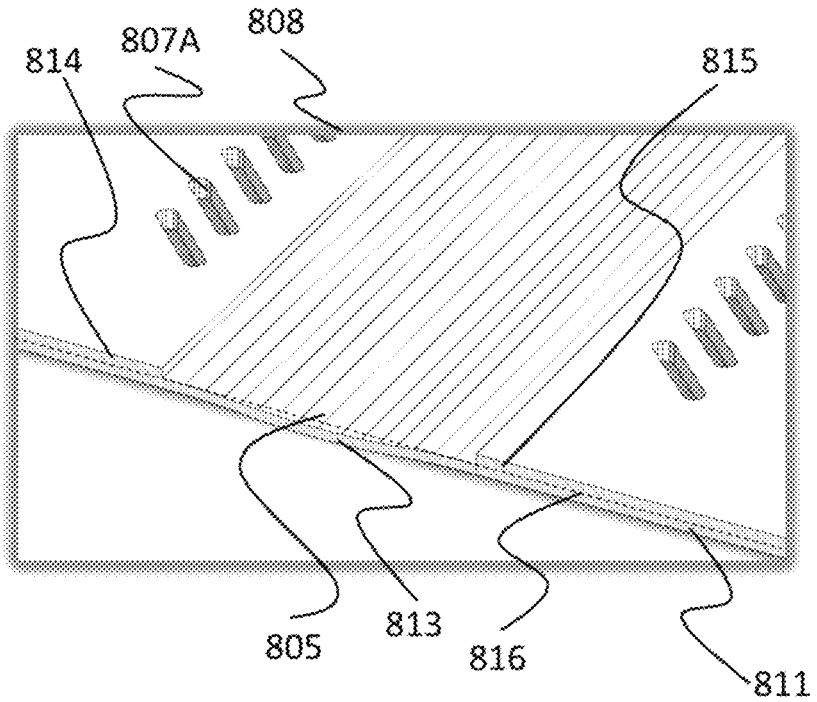
FIG. 8C illustrates a detail of a planar flow channel plate according to one embodiment of the present invention.

FIG. 8C shows some detail of area 808 for the lower plate 811 only. The plate 811 comprises lower channel wall 813 and spacers 814 and 815, with strain relief means 807A present in the lower plate 811. Dotted line 816 indicates the lower extent of the spacers.

Figure 8D:
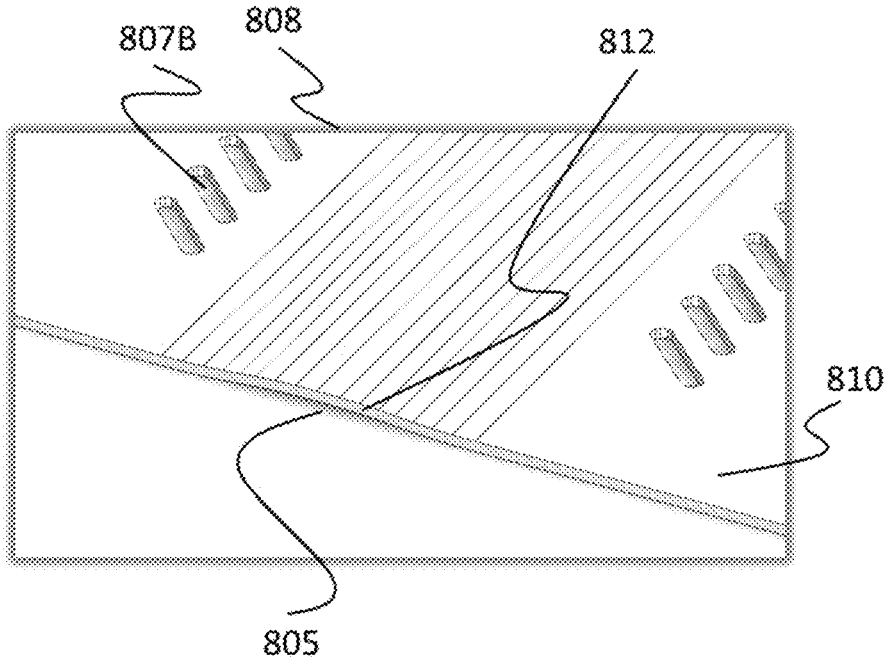
FIG. 8D illustrates a detail of a planar flow channel plate according to one embodiment of the present invention.

FIG. 8D shows some detail of area 808 for the upper plate 810 only. The plate 810 is of uniform thickness and comprises upper channel wall 812, with strain relief means 807B present in upper plate 810.

Strain relief means 807 are shown in FIG. 8A as holes extending through the full thickness of flow channel plate 800, but in other embodiments, strain relief means 807 may comprise recesses extending partly through the thickness of plate 800, or corrugations within plate 800, or thinned regions within plate 800, or regions prone to bucking under lateral expansion within plate 800, or inserts of separate material within plate 800, or other means of allowing lateral expansion of the flow channel, or combinations of any of these.

The flow channel plate 800 can be formed by laminating together two separate sheets of material 810 and 811 as discussed herein. Similar flow channel plates can be fabricated by other means. For example, flow channel plates can be formed by fine-featured three-dimensional printing means known as micro-stereolithography, using a single printing material or various materials. Other possible means of fabricating flow channel plates include, but are not limited to, stereolithography, three-dimensional printing, injection molding followed by lamination, vacuum forming followed by lamination, lamination around a mandrel, and investment casting.

The material comprising flow channel plate 800 or similar flow channel plates embodying the present invention may be one or more of poly-ether ether ketone (PEEK), polycarbonate, cyclic olefin copolymer (COC), polyvinyl chloride (PVC) with plasticizers, polyvinyl chloride without plasticizers, polymethyl methacrylate (PMMA or Plexiglass®), polyethylene, high density polyethylene, ultra high density polyethylene, polyethylene terephthalate (PET or PETE), polypropylene, Formlabs printing resin, other printing resin, silicon, glass, silicone rubber, polyimide, stainless steel, brass, and bronze. The use of other materials is also possible.

Figure 9:
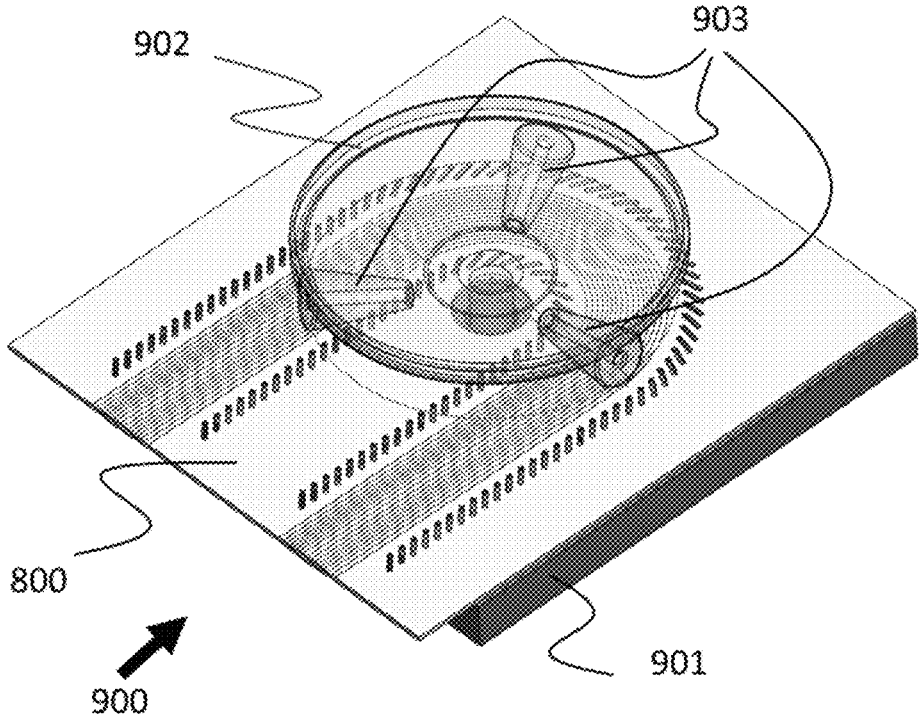
FIG. 9 illustrates a conceptual isometric view of a face roller pump head incorporating a planar flow channel plate according to one embodiment of the present invention.

FIG. 9 conceptually illustrates the use of planar flow channel plate 800 in a three-roller pump head 900 which is a face-roller pump head. Platen 901 acts as a stator and supports flow channel plate 800. Pump head 902 contains three tapered rollers 903, shown in the figure as above the planar flow channel plate 800 and ready to descend into contact. The pump head 902 drives the rollers 903 in rolling, compressive contact with plate 800 to achieve peristaltic pumping action. The pump rollers 903 are tapered, enabling them to roll in a circle on a planar face without grinding. The rollers are held in a desired relative angular position by a free-wheeling roller cage, not shown.

The pump head 900 shown in FIG. 9 is one example of a pump head which can drive planar flow channel plates such as flow channel plate 800. Other pump heads can employ segmented compressing members instead of rollers to achieve peristaltic pumping action.

Figure 10A:
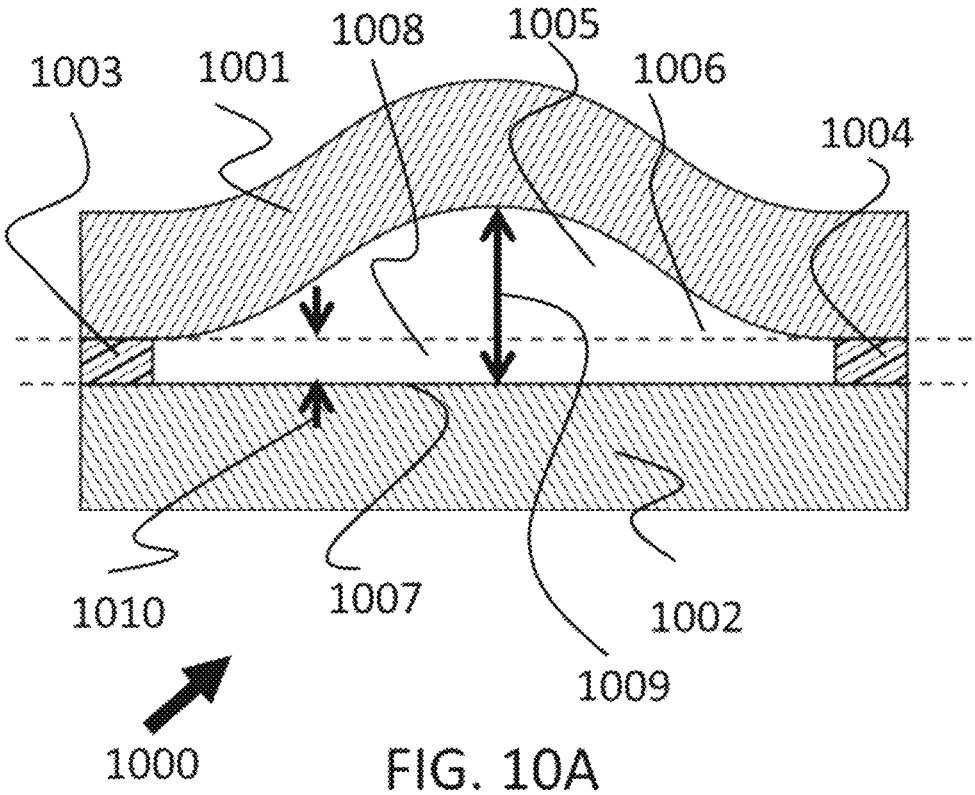
FIG. 10A illustrates a cross section of a flow channel in a relaxed state according to one embodiment of the present invention.
Figure 10B:
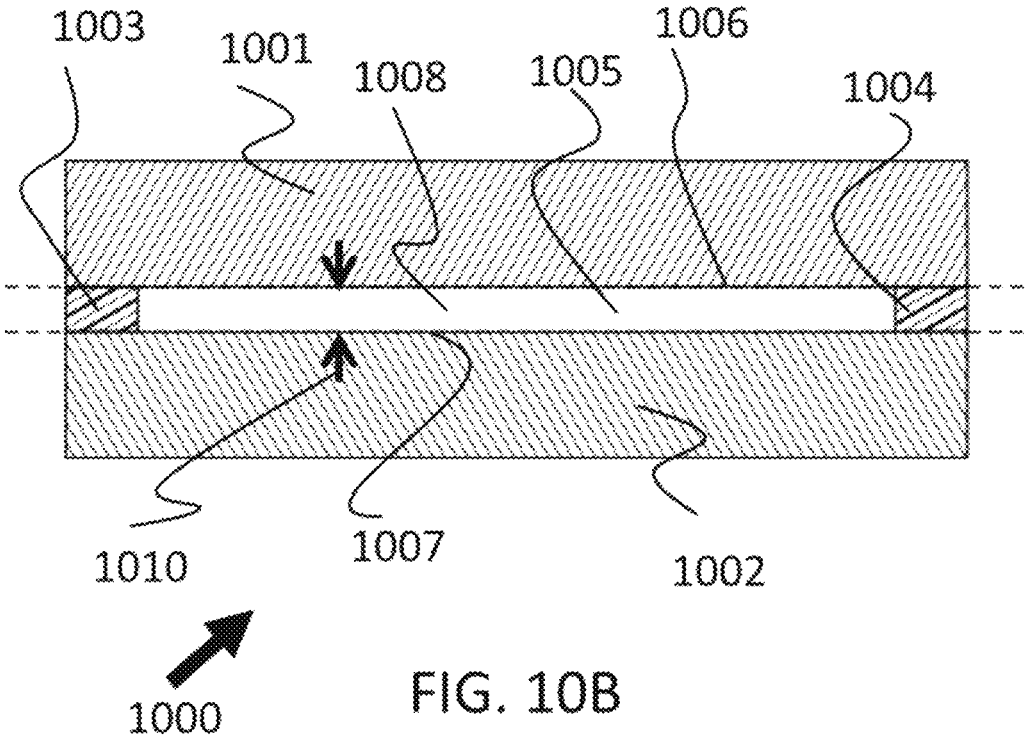
FIG. 10B illustrates a cross section of a flow channel in a compressed and under-occluded state according to one embodiment of the present invention.

FIGS. 10A and 10B illustrate a channel 1000 as an embodiment of the invention in which the upper channel wall is curved in its relaxed state while the lower channel wall is flat in its relaxed state. FIG. 10A shows the channel in its relaxed, uncompressed state while FIG. 10B shows the channel in its compressed, under-occluded state. Bowed upper wall 1001 is separated from flat lower wall 1002 by spacers 1003 and 1004, the walls and spacers defining lumen 1005 which in its relaxed state has a central gap height 1009. The under-occlusion gap 1008 which is left when the channel is compressed is indicated by dotted lines 1006 and 1007 and has a height 1010.

In order for channel 1000 to function well, bottom wall 1002 must be able to stretch laterally as the top wall 1001 expands laterally when it is compressed vertically. The lateral stretch of bottom wall 1002 can be accomplished if bottom wall 1002 comprises a material that is less stiff (having a lower Young's modulus) than the material comprising upper wall 1001, or if lower wall 1002 is thinner than upper wall 1001, or some combination.

If lower wall 1002 comprises a material less stiff than that comprising upper wall 1001, lower wall 1002 can also be much thicker than upper wall 1001, the lower wall 1002 for example comprising part of a wider thick substrate atop which spacers 1003 and 1004 and wall 1001 are disposed.

If the vertical thickness of spacers 1003 and 1004 approaches zero and becomes zero, the channel 1000 becomes a channel having no spacers which can have a fully occluded lumen during pump operation. This arrangement thus comprises a flow channel suitable for use with a peristaltic pump, the flow channel comprising an upper wall having a bowed upward shape, and a lower wall having a flat shape, wherein the upper wall and lower wall define a lumen, and wherein the bottom wall is flat, and the upper wall comprises a material having a first Young's modulus, and the lower wall comprises a material having a second Young's modulus and the second Young's modulus is lower than the first Young's modulus. This arrangement is novel in relation to prior art which used a simply bowed upper channel wall comprising a soft material having a low Young's modulus disposed atop a stiffer and more rigid flat substrate having a higher Young's modulus. Fully occluded lumens have the advantage of no leakage or low leakage in comparison to the under-occluded lumens discussed elsewhere in this description, but fully occluded lumens do not have the advantage of low hemolysis given by under-occluded lumens. When not used for pumping blood or other liquids containing fragile components, a fully occluded channel can be advantageous.

The use of under-occluded flow channels of the present invention in peristaltic pumps relieves the operator or perfusionist of the need to adjust under-occlusion before pump use, produces stable under-occlusion during pump use, and reduces or prevents hemolysis due to crushing or grinding. The use of wide channels of the present invention reduces or prevents hemolysis due to fluid shear stress. The use of channels of the present invention comprising stiff materials such as rigid PVC reduces or prevents wear and spalling of the channel material, and reduces or prevents leaching of plasticizers into blood.

Flow channels of the present invention may be built using combinations of materials rather than a single material. For example, the top or bottom wall may comprise layers of materials having different properties. The spacer regions may comprise a different material than the walls.

Flow channels of the present invention may be built using spacers of different height at the left and right lateral edges of the channel, and the height of one spacer may approach zero, or become zero so that there is a spacer only on one side of the channel. Spacers of different height may be advantageous, for example, in a pump having a channel which follows a planar semicircular path wherein the radially outward region of fluid flow tends to be faster than the radially inward region of fluid flow, resulting in higher fluid shear for the radially outward region of the under-occluded lumen. By making the radially outward spacer thicker than the radially inward spacer, fluid shear across the radial width of the under-occluded lumen can be made more uniform.

A channel of the present invention can be built having interior surfaces exposed to the pumped fluid which are more biocompatible than the rest of the channel, as is known for other blood-contacting devices.

The invention is useful for pumping fluids other than blood, including fluids having fragile components such as large fragile molecules.

Although the invention has been described with respect to particular embodiments thereof, these particular embodiments are merely illustrative, and not restrictive.

It will also be appreciated that one or more of the elements depicted in the drawings/figures can also be implemented in a more separated or integrated manner, or even removed or rendered as inoperable in certain cases, as is useful in accordance with a particular application.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

The invention claimed is:

1. A flow channel suitable for use with a peristaltic pump, the flow channel comprising:

an upper wall having a bowed upward shape;

a lower wall having one of a bowed downward shape and a flat shape; and a first spacer disposed at a first lateral edge between the upper and lower walls of the flow channel, and a second spacer disposed at a second lateral edge between the upper and lower walls of the flow channel;

wherein the upper wall, lower wall, and inner lateral surfaces of the spacers define a lumen; and wherein, when the upper wall is compressed toward the lower wall by compressing members, the spacers limit vertical movement of the compressing members such that the lumen is maintained in an under-occluded condition with a gap remaining between the upper and lower walls.

2. The flow channel of claim 1 wherein the bowed shape of one of the upper and lower walls has a recurved shape.

3. The flow channel of claim 1 wherein one of the upper and lower walls has a uniform thickness.

4. The flow channel of claim 1 wherein the lumen in its under-occluded condition has a lumen width and a lumen height, the lumen width being wider than the width of an under-occluded lumen of an area-equivalent circular tube exhibiting the same under-occluded lumen height.

5. The flow channel of claim 1, characterized by a lumen width ratio (LWR), wherein 1.5<=LWR<=3.08.

6. The flow channel of claim 1, wherein one of the upper wall, the lower wall, and each of the spacers comprises a material having an elastic modulus EMod where 24-MPa<=EMod<=3800 MPa.

7. The flow channel of claim 1, further comprising a flow path which curves about an axis perpendicular to a plane in which the flow path substantially lies.

8. The flow channel of claim 1, wherein a portion of the flow channel lies between strain relief features formed into a flow channel plate.

9. The flow channel of claim 1, wherein the lower wall is flat;

the upper wall comprises a material having a first Young's modulus;

the lower wall comprises a material having a second Young's modulus; and the second Young's modulus is lower than the first Young's modulus.

10. A disposable kit for a peristaltic pump, the disposable kit comprising:

the flow channel of claim 1; and one or more additional elements;

wherein the flow channel and the one or more additional elements are integrated to form a single assembly.

11. A method of fabricating a flow channel suitable for use with a peristaltic pump; the method comprising:

forming an upper wall having a bowed upward shape;

forming a lower wall having a bowed downward shape; and joining the upper wall and lower wall to create a lumen of the flow channel;

wherein one of forming the upper wall and forming the lower wall comprises forming two spacers protruding therefrom, such that after joining the upper wall and lower wall, the spacers serve as lateral bounds for the lumen; and wherein, when the upper wall is compressed toward the lower wall by compressing members, the spacers limit vertical movement of the compressing members such that the lumen is maintained in an under-occluded condition with a gap remaining between the upper and lower walls.

* * * * *